US005927493A

United States Patent [19]

Colombo

[11] Patent Number: 5,927,493

[45] Date of Patent: Jul. 27, 1999

[54] BLADE-HOLDING CASE FOR A HACK SAWING MACHINE

[75] Inventor: Giorgio Colombo, Valmadrera, Italy

[73] Assignee: Hardware Industrial Manufacturing s.r.l., Italy

[21] Appl. No.: 09/071,188

[22] Filed: May 1, 1998

[30] Foreign Application Priority Data

May 9, 1997 [IT] Italy ..... MI970327 U

[51] Int. Cl.[6] ..... B65D 85/28

[52] U.S. Cl. ..... 206/372; 206/352; 206/747; 206/756; 211/70.6

[58] Field of Search ..... 206/208, 352, 206/354, 373, 349, 379, 747, 745, 748, 749, 759, 765, 762, 763, 45.23, 576, 372; 211/69, 70.6

[56] References Cited

U.S. PATENT DOCUMENTS

| | | | |
|---|---|---|---|
| 2,792,934 | 5/1957 | Rocchetti | 206/378 |
| 2,792,935 | 5/1957 | Rocchetti | 206/379 |
| 4,934,530 | 6/1990 | Riess | 206/379 |
| 5,148,914 | 9/1992 | Budert et al. | 206/1.5 |
| 5,775,499 | 7/1998 | Budert | 206/379 |

FOREIGN PATENT DOCUMENTS

| | | |
|---|---|---|
| 8531422 | 1/1986 | Germany . |
| 3719170 | 10/1988 | Germany . |
| 630837 | 7/1982 | Switzerland . |
| 2124191 | 2/1984 | United Kingdom . |

*Primary Examiner*—Paul T. Sewell
*Assistant Examiner*—Nhan T. Lam
*Attorney, Agent, or Firm*—Shlesinger, Fitzsimmons & Shlesinger

[57] ABSTRACT

A blade-holding case for a hack sawing machine comprises a support (13) provided with housings (17) each intended for receiving one end of a blade (18) for supporting it in the case. Each housing (17) has an opening (19) for enabling introduction thereinto of one end of a blade inclined in a first direction (20) towards the fore portion of the housing and enabling rotation of the blade to a supporting position in a second direction (21) angularly spaced apart from the first one towards the rear portion of the housing, so as to insert the blade between lateral-fitting means (22) of the blade when the latter is in the supporting position. The blades can be advantageously inserted in the housings by their toothed fore end.

9 Claims, 2 Drawing Sheets

BLADE-HOLDING CASE FOR A HACK SAWING MACHINE

BACKGROUND OF THE INVENTION

The present invention relates to a blade-holding case for hack sawing machines.

Known in the prior art are blade-holding cases in which there is a support provided with housings having openings receiving one end of the blades, so that said blades are arranged all parallel to each other within the case, each fitted in a respective housing. Housings are such made that blade insertion and taking off occurs by an axial movement. Since an axial movement of the toothed fore end of the blades within their housings would damage the housings themselves, blades can be inserted in the respective housings only by their smooth rear end intended for coupling with the hacksaw. Therefore, for removing the blade from the container, said blade must be grasped at the toothed cutting portion and axially pulled against the action of the spring means keeping it fitted in its housing. Understandably this operation is potentially risky.

The general object of the present invention is to obviate the above mentioned drawbacks by providing a blade-holding case in which the blades are housed in a support that does not require any axial force to be exerted on the blades upon drawing them off the support. In addition, due to the absence of an axial force against a spring means, it is also possible to support the blades by inserting them in such a manner that the toothed fore end is fitted in the housing without said housing being damaged.

SUMMARY OF THE INVENTION

In view of this object, in accordance with the invention, it is provided a blade-holding case for a hack sawing machine which has a support formed with housings each intended for receiving one end of a blade for being supported in the case, characterized in that each housing has an opening for enabling introduction thereinto of one end of a blade inclined in a first direction towards the fore portion of the housing and enabling rotation of the blade to a supporting position in a second direction angularly spaced apart from the first direction towards the rear portion of the housing, the housing including means for laterally fitting the blade in the supporting position.

BRIEF DESCRIPTION OF THE DRAWINGS

For better explaining the innovatory principles of the present invention and the advantages it offers over the known art, a possible embodiment of the invention applying said innovatory principles will be given hereinafter by way of non-limiting example with the aid of the accompanying drawings. In the drawings.

DETAILED DESCRIPTION OF THE INVENTION

Figure 1:
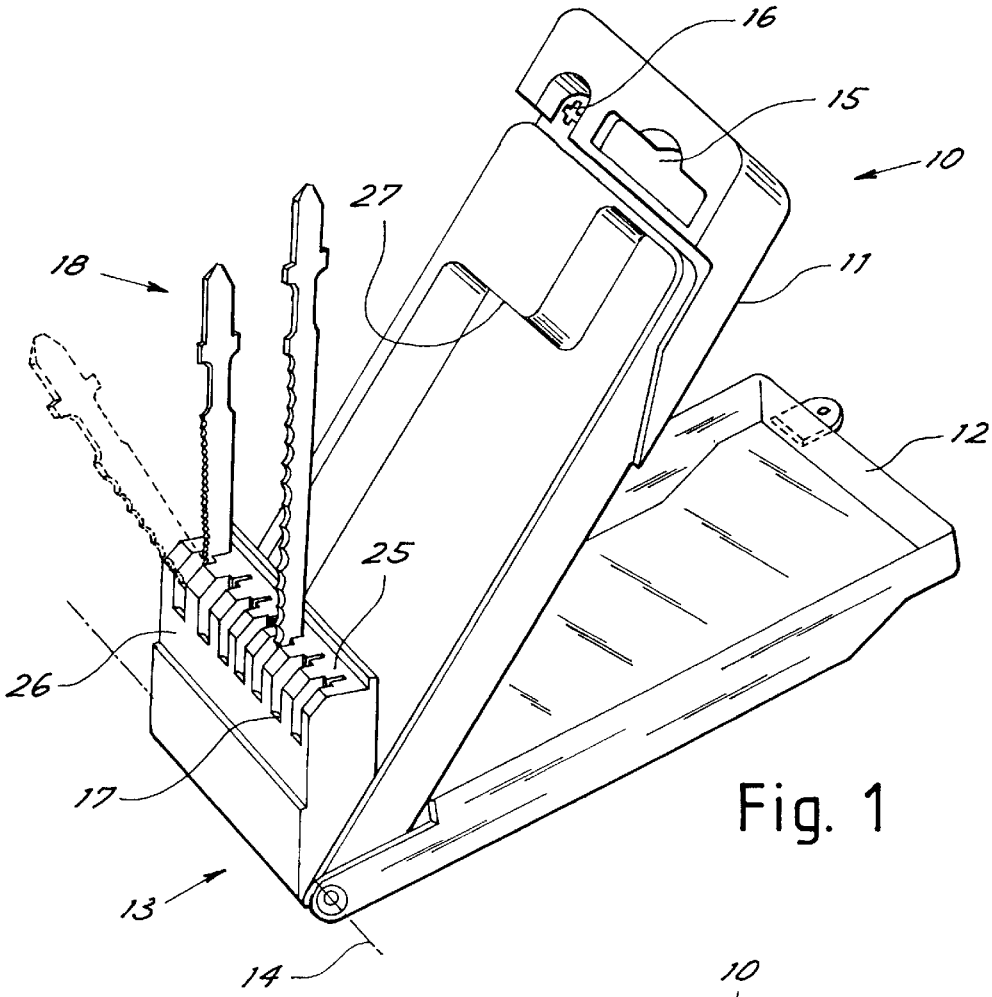
FIG. 1 shows a diagrammatic perspective view of a case made in accordance with the invention, in an open position.

With reference to the drawings, a case generally denoted by 10 is shown in FIG. 1, which case is formed of three elements including a bottom 11, a cover 12 and a support 13, which elements are hinged together along an axis 14 close to a lower end of the case.

Advantageously, as shown in FIG. 1, cover 12 can rotate until it becomes a horizontal rest foot for keeping the bottom 11 at a rearwardly-inclined raised position and the support 13 rotated out of the bottom to a nearly vertical position.

Figure 2:
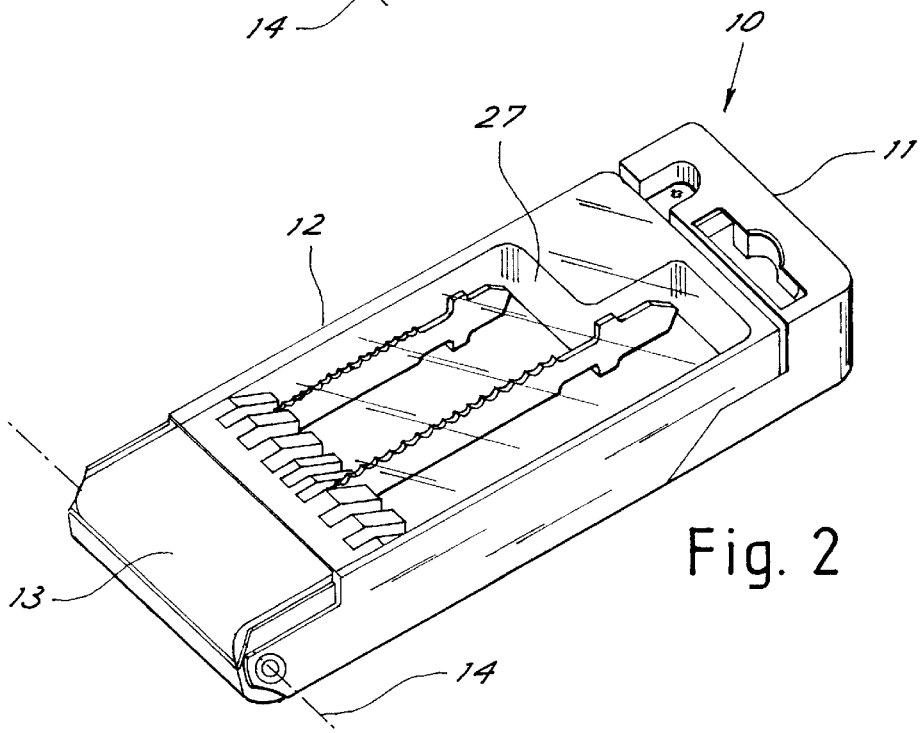
FIG. 2 shows a diagrammatic perspective view of the case in FIG. 1 in a closed position.

The case elements therefore can rotate between an open position, shown in FIG. 1, and a closed position, shown in FIG. 2, where the support is received within the bottom and the cover is closed thereupon.

A hanging hole 15 and a seat 16 for a closure seal can be supplied in the upper extremity of the bottom 11 which projects beyond the cover.

Advantageously, known cam means or spring means may be provided from automatically bringing the support 13 to the position of FIG. 1 when the cover is rotated to its maximum-opening position. Appropriate cam means is described for example in the Italian Utility Model MI95U000296 filed in the name of the same Applicant. Therefore said means will not be herein described or further shown.

Support 13 has formed in its free or upper end remote from its hinged end a plurality of spaced openings 19 forming housings 17 for receiving the blades 18 of the hack sawing machine.

For convenience, the parts forming the support 13 and housings 17 will be described with reference to the front or fore side the support face 26 which is opposite to bottom 11. As clearly shown in FIG. 3, each housing has an opening 19 extending downwardly into support 13 from its upper surface 25. Each housing 17 has formed centrally in the rear wall thereof, remote from support surface 26, a rectangular slot into the upper end of which project two, laterally spaced blade engaging projections 22. The front wall 24 of each housing 17 is shorter than the rear wall of the housing so that the opening 19 extends across the upper edge of the front wall 24 and opens on the front surface 26 of support 13. Also, the inner, laterally extending edge 23 of each housing front wall 24 forms a fulcrum point for a purpose noted hereinafter.

Figure 3:
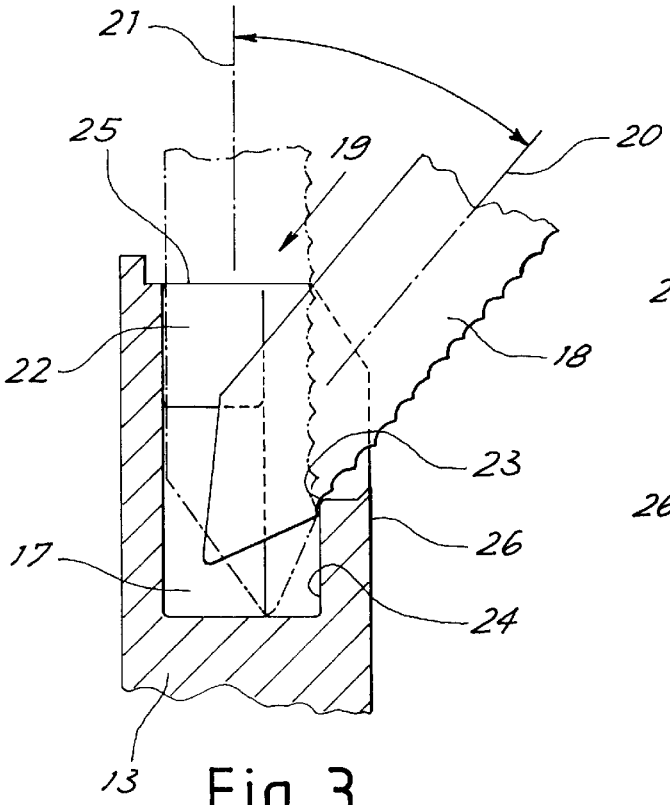
FIG. 3 shows a cross-section view of a housing present in the case in FIG. 1 for supporting a blade of a hack sawing machine.

The opening 19 of each housing 17 is thus designed to enable introduction thereinto of the toothed end of a blade inclined in a first direction 20 towards the fore portion of the housing to overlie the upper end of the forward housing wall 24, and enabling rotation of the blade to a supporting or vertical position in a second direction 21 angularly spaced apart from the first one towards the rear portion of the housing (as shown in chain line in FIG. 3). The second direction is substantially parallel to opening 19 and the extension of the housing and the support, so that in a supporting position and with the case in a closed condition the blades are received inside the bottom and parallel to the extension of the latter. For example, the first and second directions can be angularly spaced apart from each other by at least 15°, preferably 20°.

The housing opening 19, as noted above extends from an upper face 25 of the support to a front face 26 thereof.

Figure 4:
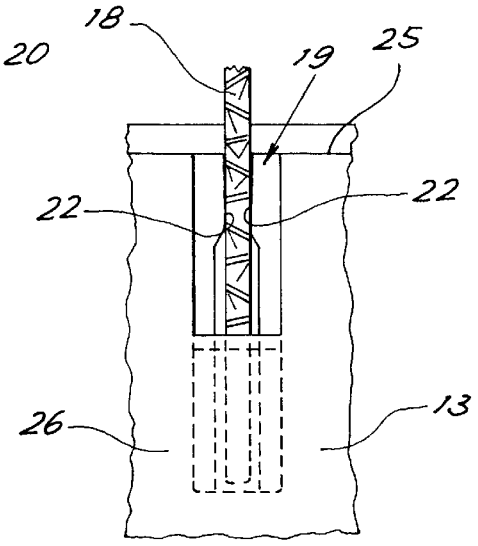
FIG. 4 shows a front view of the support housing of FIG. 3.

As clearly viewed also, from FIG. 4, the projections 22 on each housing comprises means 22 for laterally fitting and releasably gripping the blade in the supporting position. This means for laterally fitting the blade consists of a transverse narrowing of the width of the slot of the rear housing wall, so that said width is reduced from a value higher than the blade thickness to a value enabling interference with the blade. Advantageously, said narrowing is in the vicinity of the housing opening to enable the blade to enter the housing without any effort when it is inclined in the first direction 20. Thus the blade is tightly clamped by the fitting means 22 at a position axially away from its tip, which will enable an easy rotatory movement between the fitting position and the supporting position. At the front, housing 17 has a fulcrum point 23 for the end of a blade fitted therein, so that the blade is received in the housing inclined in the first direction with an edge close to and behind said fulcrum point. As a result, as clearly shown in FIG. 3, through a lever action on said fulcrum point, urging of the blade into the lateral-fitting means 22 within the housing is produced, when a blade portion projecting from the housing is pushed from the first to the second direction.

The fulcrum point is advantageously formed on a front wall of the housing, by an upper and inner corner of the front wall 24 of said housing, which is smaller in height than the opposite rear wall.

Figure 5:
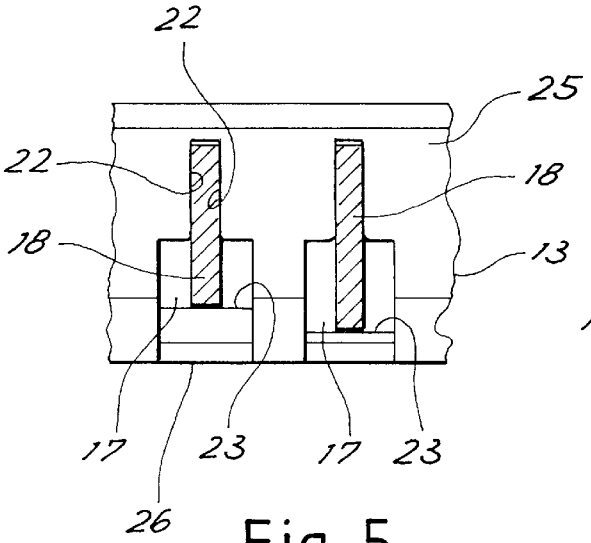
FIG. 5 is an top plan view of support housings as shown in FIG. 3.

As clearly viewed from FIG. 5, the longitudinal width of the housing, that is the distance between the front and rear walls of the housing, can vary depending on the blade width so that in the supporting position the blade is received in the housing with a small play in the direction of its width.

As shown in FIGS. 1 and 2, the space inside the bottom can have a shaped extremity 27 opposite to support 13 for receiving a plurality of blades of different lengths while only enabling a slight axial play of the blades when the case is closed, so as to prevent the blades from slipping off the housings due to impacts on the case.

At this point it is apparent that the intended purposes have been reached, by providing a blade-holding case that does not require axial forces to be carried out on the blades for drawing them out of, or inserting them into the appropriate support housings. In use, it is sufficient to put the blade tip into the housing, generally inclined in the first direction 20 (with a wide tolerance), as shown in chain line in FIG. 1 and in solid line in FIG. 3, and afterwards push the blade to the supporting position by a rotatory motion. The blade is thus transversely fitted between the lateral-fitting spring means 22, without any axial force being required. For taking the blade out of the support, it is sufficient to bring the blade back to the forwardly inclined position, so that it is slipped off by a rotatory motion from the fitting means 22, and then take it out of the housing without effort.

Since an axial force is not to be exerted on the blade, risks due to grasping of the blade for taking it out or inserting it are greatly reduced. In addition, as viewed from the figures, since no axial forces exist between the blade and housing, the blade can be advantageously inserted into the housing by its tip end. Insertion by the tip is actually even preferable in order to have a sure fitting between the fulcrum point and the blade, as clearly shown in FIG. 3.

Under this condition, the blade can be grasped by the rear end intended for coupling with the hack sawing machine, which is free of toothing. In addition, the pulling out movement takes place in a direction concordant with the direction of the blade teeth, thereby still more reducing any risk connected with the pulling out operation of the blade from the support.

Obviously, the above description applying the innovatory principles of the invention is given for purposes of illustration only and therefore must not be considered as a limitation of the scope of the invention as herein claimed.

Figure 6:
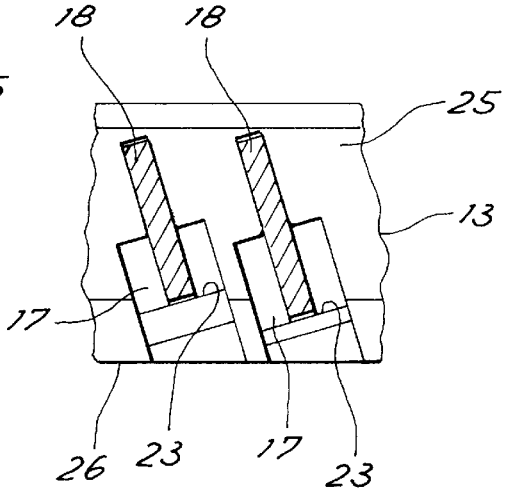
FIG. 6 is a plan view of an alternative embodiment of the support housings.

For example, as shown in FIG. 6, the blade housings can be also inclined relative to axis 14. This, for instance, enables the inscriptions that are usually placed on the blade side faces to be made more visible.

In addition, the case too may be different from the one shown and be differently sized in order to adapt it to specific requirements and to the number and shape of the blades to be put therein.

What is claimed is:

1. Blade-holding case for hack sawing machine, which case has a support having formed therein housings each intended for receiving one end of a blade for supporting the blade within the case, characterized in that said support has a top face and a front face, each housing is defined by an opening extending downwardly into said support from said upper face thereof, and opening laterally at the upper end thereof on both said front and top faces of said support, said opening enabling introduction thereinto of one end of a blade initially inclined in a first direction towards said front face of said support and a front portion of the housing, and thereafter enabling rotation of the blade to a supporting position in a second direction angularly spaced apart from the first direction towards a rear portion of the housing, said housing comprising gripping means for releasably securing the blade in the supporting position.

2. A case as claimed in claim 1, characterized in that the housing at said front portion has thereon a fulcrum point spaced below said top face for engagment by a blade inserted therein, the housing receiving a blade inclined in the first direction with a blade edge thereof engaging said fulcrum point to produce the blade thrust into the gripping means of the housing, through a lever action on said fulcrum point, when a blade portion projecting from the housing is pushed from the first direction to the second direction.

3. A case as claimed in claim 2, characterized in that the fulcrum point is formed on a front wall of the housing.

4. A case as claimed in claim 1, characterized in that the said means consists of a transverse narrowing of the housing width.

5. A case as claimed in claim 4, characterized in that the narrowing is close to the housing opening.

6. A case as claimed in claim 1, characterized in that the housing opening extends from said top face of the support to said front face thereof.

7. A case as claimed in claim 1, characterized in that the first and second directions are angularly spaced apart from each other in the range of 15°, to 20°.

8. A case as claimed in claim 1, characterized in that the case comprises a bottom, a cover and the support hinged together along an axis close to one end of the case to enable rotation of the cover between a closed position in which the support is received in the bottom and the cover is closed thereupon, so that the blades carried in the housings are received within the bottom, and an open position in which the cover and support are at positions angularly spaced apart from the bottom so that the blades carried in the housings are out of the bottom.

9. A case as claimed in claim 8, characterized in that the cover in its open position forms a rest foot for keeping the bottom in a rearwardly-inclined raised position and the support in a position showing its housings turned upwardly.

* * * * *